United States Patent [19]

Riker

[11] Patent Number: 4,563,135

[45] Date of Patent: Jan. 7, 1986

[54] PUMP FOR CONCRETE OR THE LIKE

[76] Inventor: Rudolf Riker, Potsdamer Str. 16, D-8940 Memmingen, Fed. Rep. of Germany

[21] Appl. No.: 577,346

[22] Filed: Feb. 6, 1984

[30] Foreign Application Priority Data

Feb. 12, 1983 [DE] Fed. Rep. of Germany ..... 3304985

[51] Int. Cl.[4] ..... F04B 7/00

[52] U.S. Cl. ..... 417/517; 417/519; 417/532; 417/900; 92/171

[58] Field of Search ..... 417/516, 517, 518, 519, 417/532, 900; 92/128, 171

[56] References Cited

U.S. PATENT DOCUMENTS

| | | | |
|---|---|---|---|
| 3,037,460 | 6/1962 | Guest et al. | 92/171 |
| 3,137,216 | 6/1964 | Aytes | 92/171 |
| 3,266,435 | 8/1966 | Smith | 417/519 |
| 3,532,442 | 10/1970 | Van Der Plaats | 417/518 |
| 3,639,086 | 2/1972 | Robbins | 417/900 |
| 3,811,802 | 5/1974 | Semple | 417/900 |
| 4,019,839 | 4/1977 | Schwing | 417/517 |
| 4,258,612 | 3/1981 | Kuhlmann | 417/900 |
| 4,373,875 | 2/1983 | Schwing | 417/900 |

FOREIGN PATENT DOCUMENTS

| | | | |
|---|---|---|---|
| 2632816 | 1/1978 | Fed. Rep. of Germany | 417/900 |

*Primary Examiner*—Carlton R. Croyle
*Assistant Examiner*—Donald E. Stout
*Attorney, Agent, or Firm*—Kuhn Muller and Bazerman

[57] ABSTRACT

A concrete pump comprises a water rinsing box, a valve housing and a pair of concrete pump cylinders therebetween. The rinsing box and the valve housing are welded at opposite ends of rigid connecting means such forming a rigid undetachable structure in which the cylinders are removably fastened and can be drawn out through the valve housing after removal of a housing closure flap.

8 Claims, 8 Drawing Figures

FIG.7
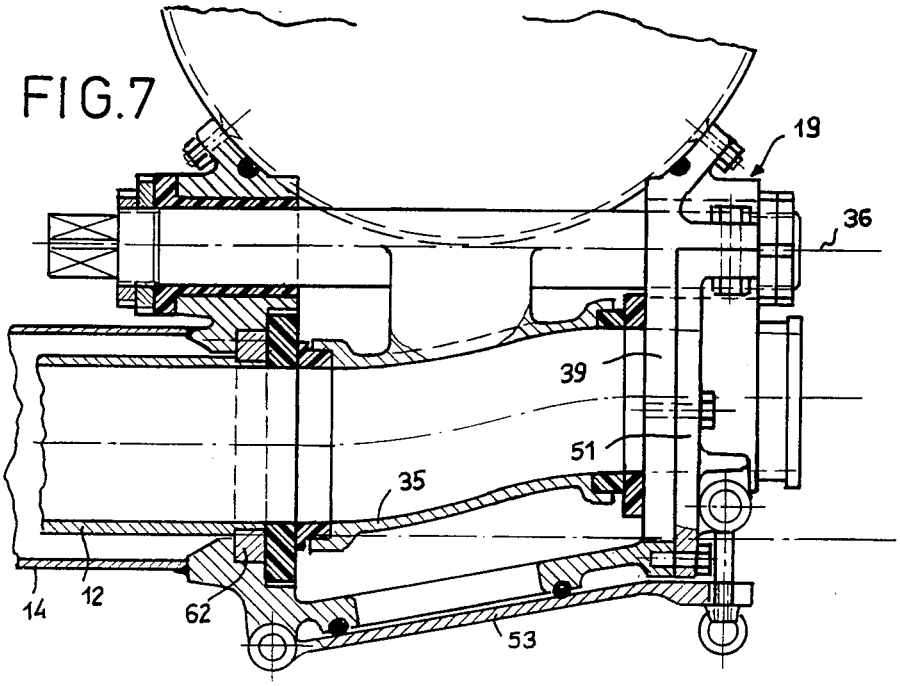
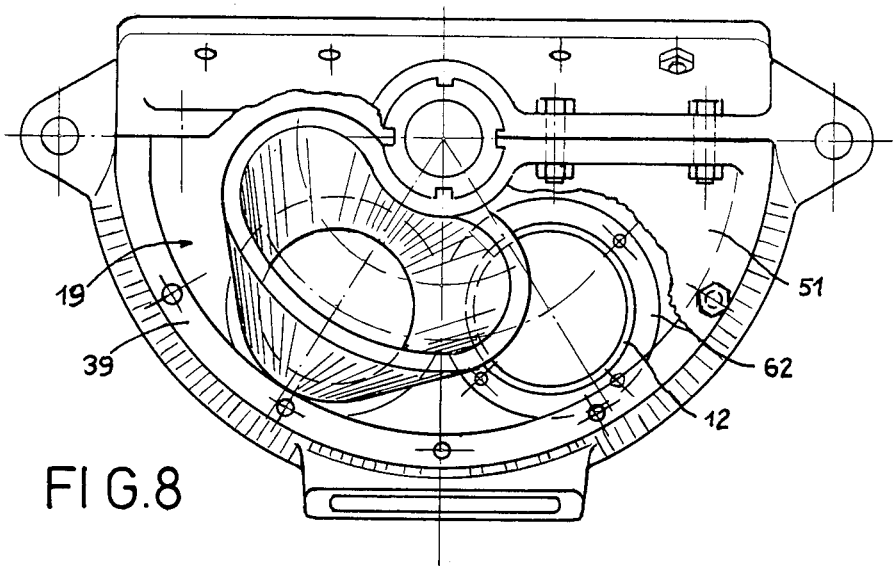
FIG.8

PUMP FOR CONCRETE OR THE LIKE

This invention relates to a pump for concrete or the like, comprising a pair of pump cylinders communicating between a rinsing box and a valve housing, a feeding hopper arranged on said valve housing, a tubular swing valve body mounted for swivelling movement within said housing about a swivelling axis arranged in a central plane between said pair of pump cylinders and arranged above the axes of the pump cylinders and in parallel relationship therewith, the valve housing comprising movable closure means.

Several types of pumps of this art are known. They distinguish from one another mainly by different types of tubular swing valve bodies. However, in all known concrete pumps the pair of pump cylinders are detachably fastened at the water rinsing box and at the valve housing. This dismounting principle provides severe problems, such as precisely aligning the pump cylinders during assembling, sealing the pump cylinders at the valve housing, and providing sufficient stiffness against deformation. This principle must be maintained, however, because the pump cylinders get worn and must be replaced periodically. Such a replacement of the pump cylinders makes it necessary to dismount the pump in a mechanical workshop. This involves a considerable loss of time. Although only particular local inside surfaces of the cylinders get worn, the cylinders as a whole must be replaced, because the wearing process is rapidly increased at those points where abrasion has begun.

Therefore, it is one object of the invention to provide a concrete pump in which the pump cylinders can be replaced quickly and easily.

A further object of the invention is to provide a novel concrete pump in which the pump cylinders thereof can be replaced without dismounting the rinsing box valve housing arrangement.

It is a further object of the invention to provide a concrete pump having a high degree of rigidity without increasing the wall thicknesses and the weight of the pump unit.

A further object of the invention is to provide a pump in which the pump cylinders can be used for a longer period of time in instances where abrasion has taken place.

A further object of the invention is to provide a pump avoiding any screws or bolts for holding the rinsing box and the valve housing in co-operational relationship.

Another object of the invention is to provide a concrete pump in which a hollow swing valve body is used, having a circular discharge end, the axis thereof coinciding with the swing axis, and wherein the valve body can be dismounted without having previously removed the feeding hopper from the valve housing.

Last not least, it is an object of the invention to provide a novel principle of a concrete pump which allows the production of the pump with lower costs and with a smaller number of component parts.

The invention is mainly characterized in that the rinsing box and the valve housing are undetachably connected with one another by rigid connecting means welded at said valve housing and at said rinsing box, thereby forming a rigid integral structure unit. The pair of pump cylinders are formed as flangeless cylinder tubes respectively rotably mounted in said structure unit at both ends thereof. Detachable fastening means are provided at one end of each of said pair of pump cylinders, securing said pair of pump cylinders at said structure unit. Axial projections of the peripheries of said pair of pump cylinders intersect said movable closure means of said valve housing, whereby each one of said pair of pump cylinders can be axially extracted through said valve housing after said fastening means and said closure means have been removed.

Due to the fact that the pump cylinders can be easily moved merely by loosening one fastening ring, the cylinder can be rotated about a certain angle to move a worn portion to a new position, thereby extending the lifetime of the cylinders. Also, the cylinders can be easily drawn out of the rigid unit, turned about 180°, and again inserted with exchanged ends to increase the lifetime thereof.

Further objects, features and advantages of the invention can be gained from the following description in connection with the drawings, which show embodiments of the invention by way of example.

FIG. 7 is a side view of a second embodiment of the valve housing of the pump, partly shown in cross-section.

FIG. 8 is a front view of the valve housing according to FIG. 7.

Figure 1:
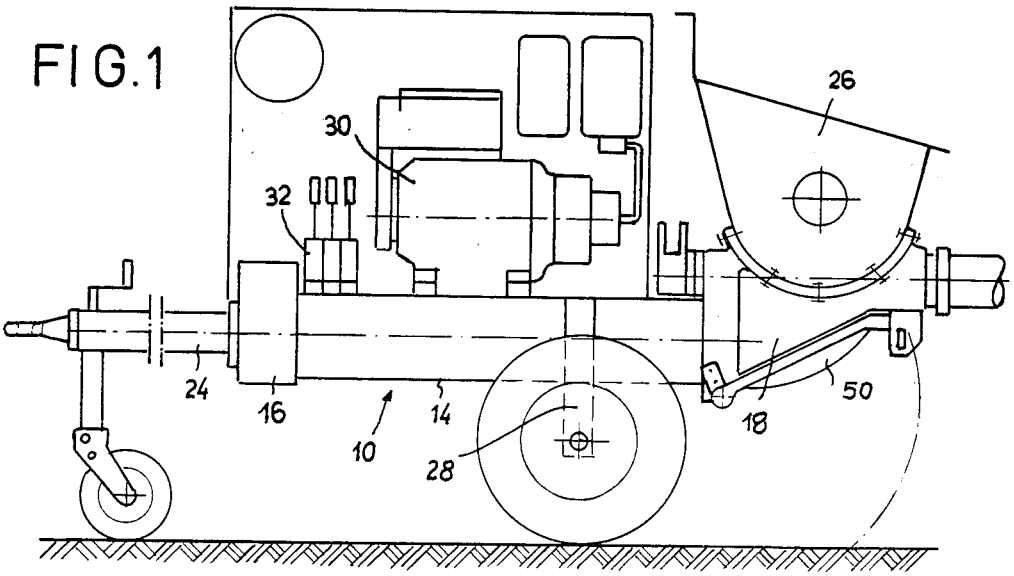
FIG. 1 is a side view of a travelling concrete pump.
Figure 2:
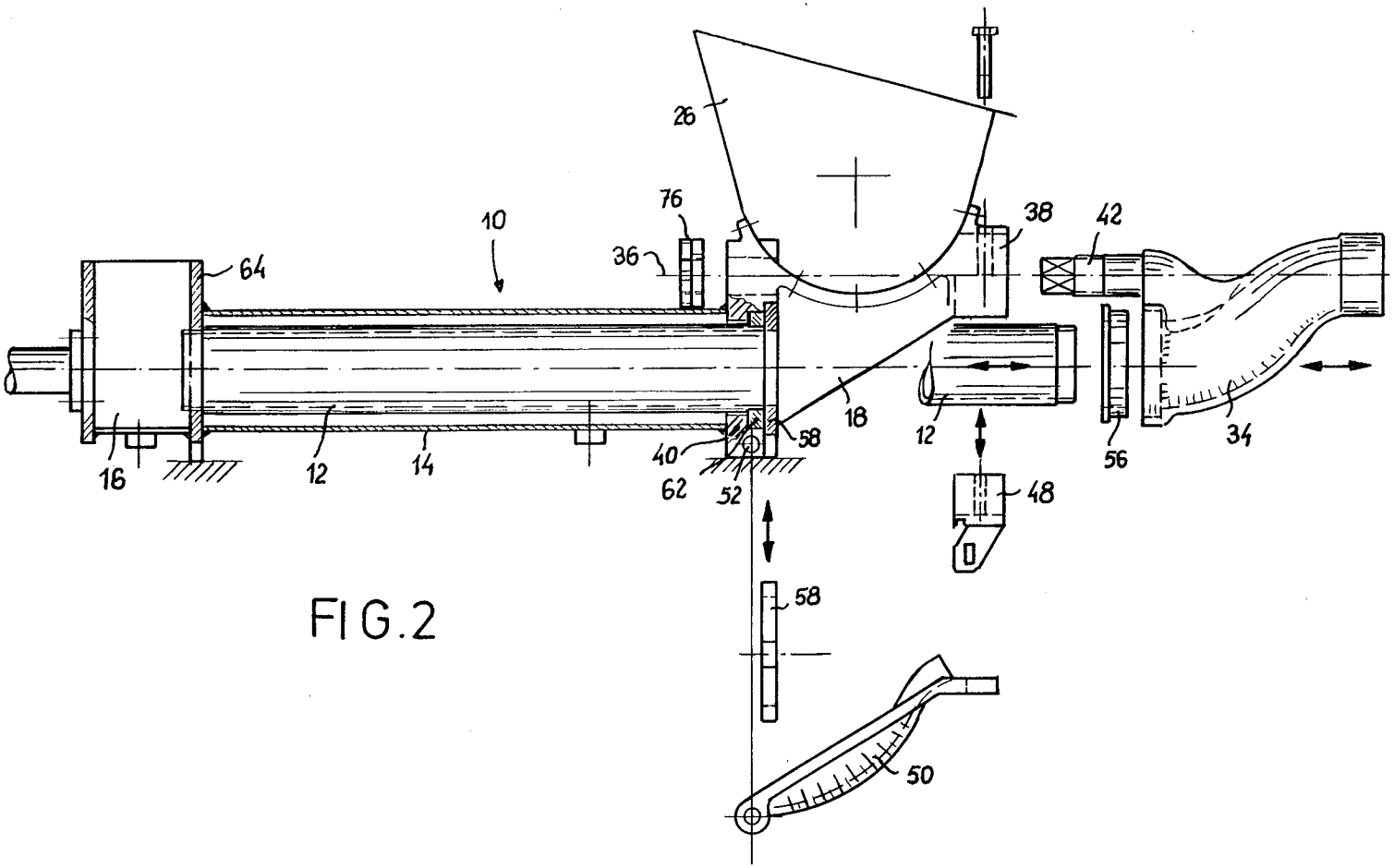
FIG. 2 is an exploded view of the essential elements of the pump unit.
Figure 3:
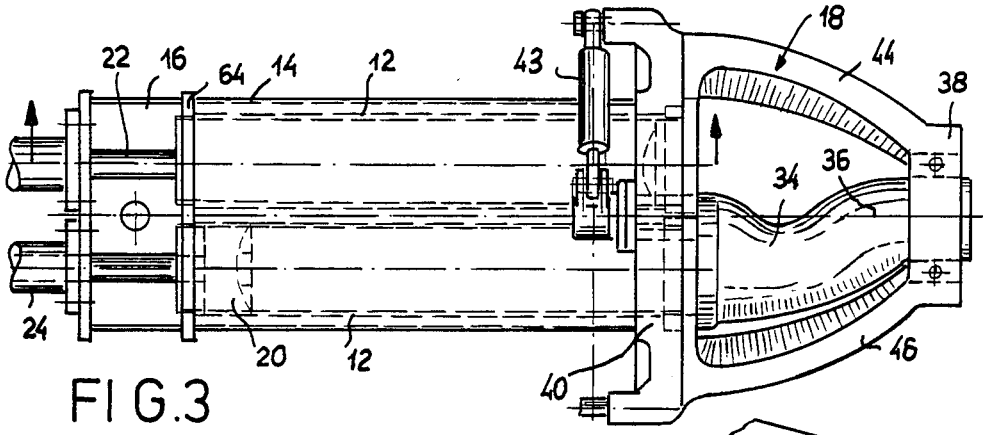
FIG. 3 is a plan view of the pump unit.
Figure 4:
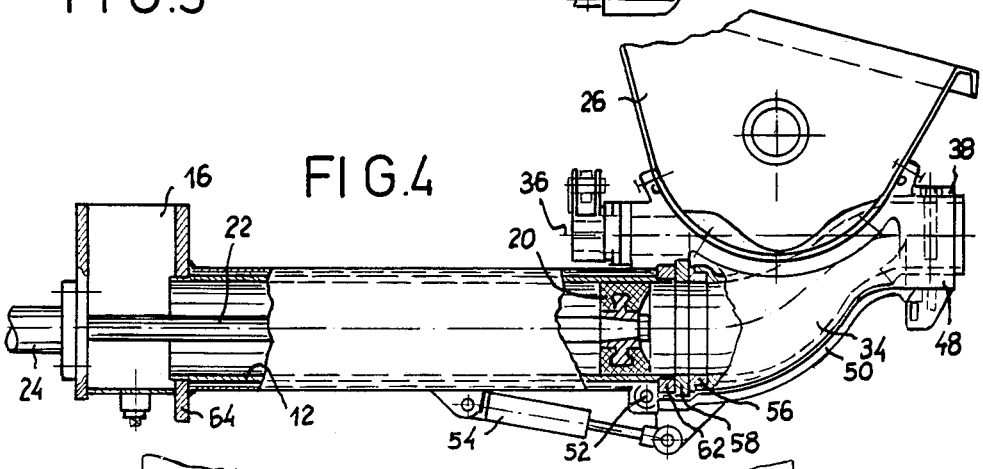
FIG. 4 is a side view of the pump, unit, partly shown in cross-section.

A concrete pump 10 comprises a prismatical sheet-metal connecting box 14 surrounding a pair of tubular pump cylinders 12. One end of the connecting box 14 is welded at a water rinsing box 16; the other end is welded at a valve housing 18. The unit consisting of the 3 components 14, 16, 18 therefore forms an integral undetachable rigid structure. A piston 20 in each one of the pair of cylinders 12 is connected with a piston rod 22 which extends through the rinsing box 16 into one of a pair of hydraulic cylinders 24 and is provided with a second piston (not shown) therein. A feeding hopper 26 is fastened on the valve housing 18. The connecting box 14 is self-supporting and the necessary equipment including supports or brackets 28, hydraulic pump and motor unit 30, and control mechanism 32, are fastened at the connecting box.

A tubular valve body 34 is arranged within the valve housing 18 and mounted to enable a swivelling movement about an axis 36 which lies above the cylinders 12 and parallel therewith in the plane of symmetry thereof. The discharge end of the valve body 34 forms a socket, the axis of which coincide with the swivelling axis 36. The socket is mounted in a bearing of a front wall 38 of the valve housing. A coaxial shaft 42 of the valve body 34 is mounted in a back wall 40 of the housing 18 and projects beyond that back wall. An hydraulic cylinder 43 is operatively connected with a swinging arm of the shaft 42. The front wall 38 integrally formed with side walls 44, 46 and the back wall 40 of the housing supports an upper half of the bearing for the discharge socket of the valve body 34. The lower half of that bearing is formed in a slide 48 which is fastened by screws at the front wall 38 and can be removed downwardly. A bottom flap 50 closing the housing 18 is pivotably mounted at the back wall 40 about an axis 52.

Figure 6:
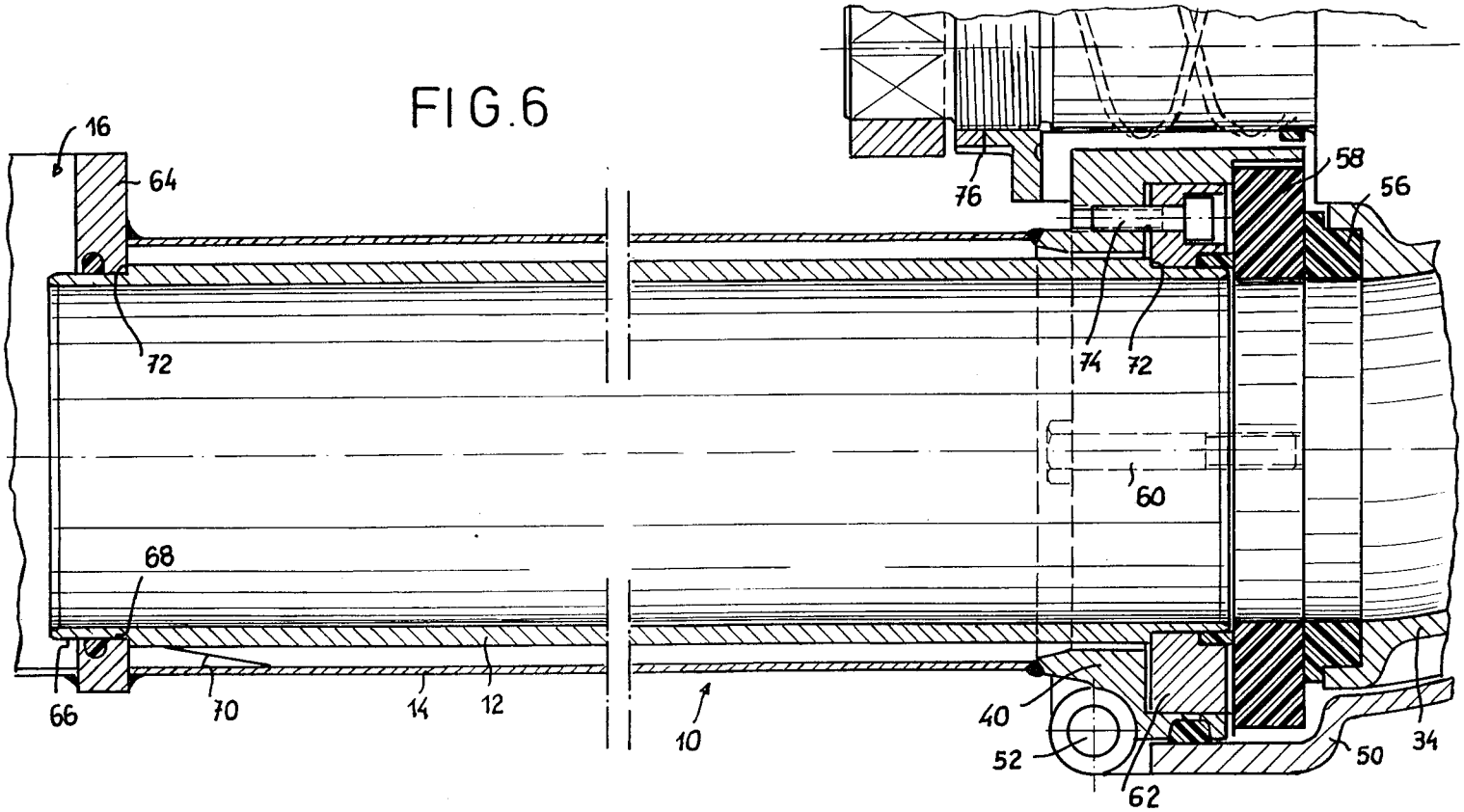
FIG. 6 is a sectional view of the bearing of one pump cylinder in the structural unit in greater detail.

The bottom flap 50 can be swung in a closing position by means of an hydraulic cylinder 54 and locked at the slide 48 or the front wall 38. A wearing ring 56 is inserted in the feeding end of the valve body 34. The wearing ring 56 contacts a two-part wearing plate 58 fastened at the back wall 40 by means of screws 60 which are inserted from the outside of the back wall 40. The pivot axis 52 of the bottom flap 50 is backwardly offset sufficiently so that in the open position of the bottom flap 50 the wearing ring 56 and both parts of the wearing plate 58 can be dismounted downwardly one after another, maintaining the valve body 34 in the operating position. Having removed one half of the wearing plate 58, a clamping ring 62 is accessible, which presses the pump cylinder 12 against the front wall 64 of the rinsing box 16, as can be seen in FIG. 6. Both ends of the pump cylinder 12 are formed identically. Each cylinder end is flangeless. Instead of an end flange, each is provided with an end portion 66 which is stepped at the outside and lies on a smaller diameter than the rest of the cylinder 12 such that an annular shoulder 72 is formed therebetween. The rinsing box front wall 64 is provided with a pair of holes 68 in which the cylinder end portions 66 are fitted respectively. On the bottom of the connecting box 14 guide ramps 70 are fastened for aligning the cylinders 12 with the holes 68 during the axial assembling operation thereof. In the operating position of the cylinder 12, the annular shoulder 72 at the rinsing box 16 contacts the front wall 64 thereof, while the annular shoulder 72 at the valve housing 18 is contacted by the clamping ring 62 fitted on the adjacent cylinder end portion 66. The clamping ring is fastened at the back wall 40 by four screws 74 from the inside of the valve housing 18.

Figure 5:
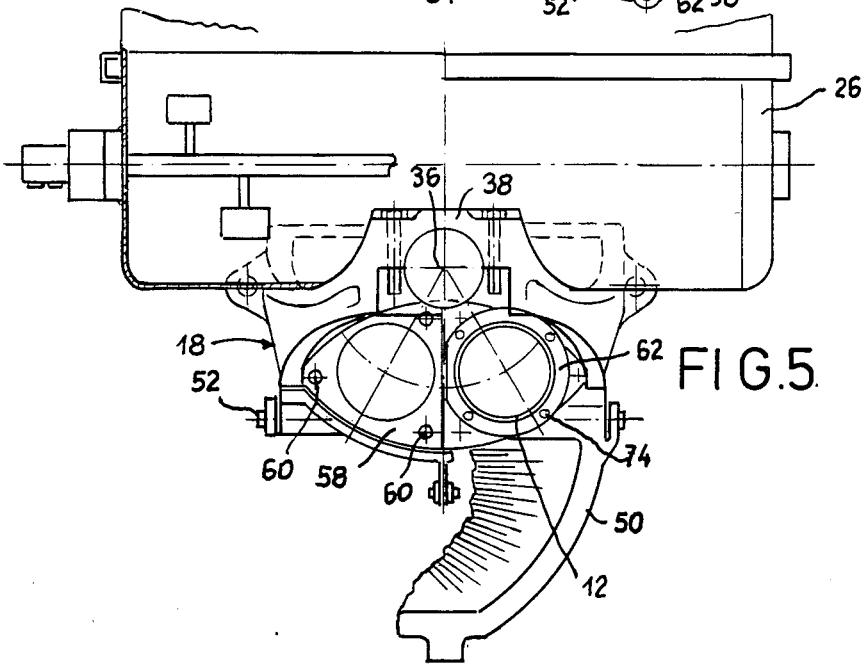
FIG. 5 is a front view of the pump unit.

After having removed one half of the wearing plate 58, (right half in FIG. 5) the screws 74 can be loosened or removed through the opened valve housing 18 and the cylinder 12 can then be rotated into another angular position, maintaining the valve body 34 in one of its operating positions. The cylinder 12 also can be drawn out axially through the opened valve housing without previously having removed the valve body 34, due to the fact that the axial projection of the cylinder periphery completely lies within the bottom flap 50. Because of the identical ends of the cylinder 12 the cylinder can be inserted again with exchanged ends to bring a worn area within the cylinder from a position adjacent the valve housing 18 to a new position adjacent the rinsing box 16.

The embodiment of FIGS. 7 and 8 shows a valve body 35 which differs from the valve body 34 in that the discharge socket is not circular and the axis thereof does not coincide with the swivelling axis 36. The discharge opening of the valve body 35 is kidney shaped and is reciprocated during the swivelling movement of the valve body 35. The valve housing 19 has a ring shaped peripherally closed front wall 39 at which a front plate 51 is removably fastened by screws. In this embodiment the front plate 51 closing the valve housing at the front side forms the movable closure means. After removal thereof, the cylinders 12 can be drawn out through the housing 19 as mentioned above with respect to the first embodiment, with the difference that the valve body 35 must previously have been dismounted. A bottom flap 53 can also be opened, making it easy to detach the clamping ring 62. However, the cylinder 12 can be extracted axially through the valve housing 19 without opening the bottom flap 53.

In this embodiment, shown only by way of example, the connecting means rigidly connecting the valve housing 18 or 19 with the rinsing box 16 is designed in the form of a sheet-metal box 14. It should be understood, however, that other types of rigid connecting means can be used instead of the sheet-metal box. For example, an open frame or a pair of longitudinally extending struts can be provided. Connecting tubes can also be welded at the valve housing and at the rinsing box, such tubes forming guide means for the cylinders 12 received therein. The present invention leads to the additional advantage that the cylinders are relieved of any bending stresses, so that they can be designed to have a smaller wall thickness.

I claim:

1. An improvement in a pump for conveying concrete or the like, the pump comprising a pair of parallel pump cylinders communicating between a water rinsing box and a valve housing, a feeding hopper arranged on said valve housing, a tubular swing valve body mounted for swivelling movement within said housing about a swivelling axis arranged in a central plane between said pair of pump cylinders and arranged above the axes of the pump cylinders, said water rinsing box and said valve housing connected with one another by rigid connecting means and thereby forming a rigid structure unit, said pair of pump cylinders formed as flangeless cylinder tubes respectively rotably mounted in said structure unit at both ends thereof, and detachable fastening means provided at one end of each of said pair of pump cylinders, securing said pair of pump cylinders at said structure unit; THE IMPROVEMENT COMPRISING:

said rigid structure unit being formed as an integral structure undetachably connecting the water rinsing box with the valve housing by welding; the valve housing being provided with a movable closing means closing a maintenance opening thereof and arranged at a position such that imaginary axial projections of the peripheries of both said pump cylinders intersect said closure means, whereby after having opened said closure means and removed said fastening means, each one of said pair of pump cylinders are axially extractable through said maintenance opening of the unremovable valve housing.

2. An improvement as claimed in claim 1, wherein said rigid integral structure unit is formed by a self-supporting box-like element, surrounding said pair of pump cylinders and on which brackets and driving means are fastened.

3. An improvement as claimed in claim 1, wherein said fastening means of each one of said pair of pump cylinders comprises a fastening ring fitted on a pump cylinder end and fastened within said valve housing at a back wall thereof.

4. An improvement as claimed in claim 1, wherein the movable closure means are formed by a bottom flap pivotably mounted at the bottom side of a back wall of the valve housing and ascending in discharge direction up to a level above imaginary axial projections of the uppermost generating lines of the outside peripheries of both said pump cylinders.

5. An improvement as claimed in claim 1, wherein a bearing of the swing valve body at the discharge end thereof is made of two halves, an upper half being integral with the valve housing and a lower half thereof being removably fastened at an end wall of the valve housing.

6. An improvement as claimed in claim 4, wherein said bottom flap is locked at the bottom side of an end wall of the valve housing.

7. An improvement as claimed in claim 4, wherein an hydraulic cylinder unit is pivoted between the bottom flap and a bottom wall of said rigid structure unit.

8. An improvement as claimed in claim 1, wherein at the bottom of the rigid structure unit adjacent to the water rinsing box, guide ramps are provided for self-aligning the pump cylinders with mounting holes provided in the front wall of the water rinsing box during axial insertion of the pump cylinders.

* * * * *